US005643041A

United States Patent [19]

Mukaida

[11] Patent Number: 5,643,041

[45] Date of Patent: Jul. 1, 1997

[54] TOY VEHICLE HAVING ADJUSTABLE LOAD CLEARANCE

[75] Inventor: Kenzi Mukaida, Tokyo, Japan

[73] Assignee: Nikki Co., Ltd., Tokyo, Japan

[21] Appl. No.: 456,000

[22] Filed: May 31, 1995

[30] Foreign Application Priority Data

Jan. 10, 1995 [JP] Japan ..... 7-002111

[51] Int. Cl.[6] ..... A63H 30/04

[52] U.S. Cl. ..... 446/455; 446/456; 446/466; 446/487; 280/39; 280/781

[58] Field of Search ..... 446/62, 67, 454, 446/456, 465, 466, 469, 470, 487; 280/39, 209, 781

[56] References Cited

U.S. PATENT DOCUMENTS

| | | | |
|---|---|---|---|
| 1,665,151 | 4/1928 | Williams | 280/39 |
| 2,216,497 | 10/1940 | McHenry | 446/466 |
| 2,836,253 | 5/1958 | Lovell | 446/454 |
| 3,677,572 | 7/1972 | Fontan et al. | 280/39 |
| 3,742,507 | 6/1973 | Pirre | 446/454 |
| 3,867,993 | 2/1975 | Iizuka . | |
| 4,508,516 | 4/1985 | D'Andrade | 446/454 |
| 4,696,655 | 9/1987 | D'Andrade | 446/469 |
| 5,108,126 | 4/1992 | Banse | 446/466 |
| 5,259,808 | 11/1993 | Garr | 446/469 |
| 5,312,288 | 5/1994 | Williams | 446/466 |
| 5,334,077 | 8/1994 | Bailey | 446/469 |

FOREIGN PATENT DOCUMENTS

| | | | |
|---|---|---|---|
| 6327845 | 11/1994 | Japan | 446/456 |
| 2130495 | 6/1984 | United Kingdom | 446/440 |
| 9107539 | 5/1991 | WIPO | 280/39 |

*Primary Examiner*—Robert A. Hafer
*Assistant Examiner*—Jeffrey D. Carlson
*Attorney, Agent, or Firm*—Young & Thompson

[57] ABSTRACT

A toy vehicle comprising a body and a chassis on which the body is mounted through connecting members. The chassis has front and rear tires. The chassis is divided on its center axis along a longitudinal direction of the chassis into two parts comprising left and right side portions. A gear is provided on the center axis for coupling the left and right side portions of the chassis to hinge the left and right side portions with each other.

32 Claims, 15 Drawing Sheets

TOY VEHICLE HAVING ADJUSTABLE LOAD CLEARANCE

FIELD OF THE INVENTION

This invention relates to a toy vehicle, and more particularly to a toy vehicle which shows a change in its load clearance and which can run not only on the land but also on the surface of water.

BACKGROUND OF THE INVENTION

Various types of attractive toy vehicles have been known such as racing cars, track vehicles, buggy cars and a vehicle running on a water surface. Such vehicles were designed to have attractive shapes and be capable of showing attractive performances in traveling. However, there has been no vehicle showing an attractive modification in shape of the vehicle, namely a body or a chassis, on traveling.

SUMMARY OF THE INVENTION

Accordingly, it is an object of the present invention to provide a novel toy vehicle which can change its load clearance to easily pass over the obstacles.

It is a further object of the present invention to provide a toy vehicle which has a simple structure suitable for changing easily its load clearance.

It is a still further object of the present invention to provide a toy vehicle which can run freely not only on the land but also on the surface of water.

The above and other objects, features and advantages of the present invention will be apparent from the following descriptions.

In accordance with the invention, there is provided a toy vehicle comprising a body, a chassis on which the body is mounted through connecting members and the chassis being provided with at least front and rear tires and also being divided at its center axis along the longitudinal direction of the chassis into left and right side portions, and a coupling unit for coupling the left and right side portions of the chassis at the center axis so that the left and right side portions are hinged to each other.

It is preferred that the toy vehicle further comprises at least one first driving unit being provided to the chassis for driving the tires.

It is also preferred that the toy vehicle further comprises a control unit being provided to the chassis for controlling the first driving unit.

It is also preferred that the control unit comprises a switch mechanism for having the first drive unit turn on or off.

It is also preferred that the control unit is controlled by a radio-control for controlling the first drive unit.

It is also preferred that the control unit is controlled by a wire-remote-control for controlling the first drive unit.

It is also preferred that a toy vehicle further comprises a drive mechanism being provided on each of the left and right side portions of the chassis to connect the front tires and the rear tires, at least one first drive unit being provided to each of the driving mechanisms for simultaneously driving the tires.

It is also preferred that the driving mechanism comprises a plurality of gears arranged between the tires for transmitting a driving power generated by the driving unit into the tires.

It is also preferred that the toy vehicle further comprises a chassis having a control unit for controlling the first drive unit.

It is also preferred that the control unit comprises a switch mechanism for having the first drive unit turn on or off.

It is also preferred that the control unit be controlled by a radio-control for controlling the first drive unit.

It is also preferred that the control unit be controlled by a wire-remote-control for controlling the first drive unit.

It is also preferred that the toy vehicle further comprises a coupling unit having a second drive unit for making the left and right side portions of the chassis hinge with each other.

It is also preferred that the second drive unit further comprises a first gear being attached at least to the left or right side portions of the chassis for making the left and right side portions of the chassis hinge to each other, at least one second gear being engaged with the first gear for driving first gear, and a motor being connected to one of the second gears for driving the second gear.

It is also preferred that the second gears further comprises at least one first drive gear being connected to the motor, at least one transmission gear being engaged to the first drive gear for transmitting a driving power generated by the motor and at least one drive gear being engaged to one of the transmission gears and the first gear attached to at least both the left or right side portions of the chassis for rotating the first gear to make the left and right side portions of the chassis hinge to each other.

It is also preferred that the second gears further comprises a clutch mechanism for preventing the gears from breaking when an external force is added to the toy vehicle so that the left and right side portions are compulsorily hinged each other.

It is also preferred that the clutch mechanism comprises large and small gears adopted to act as the second gears, wherein the large gear is provided its center portion with a disk-like convex portion and a plurality of recess portions provided around the disk-like portion, the small gear is provided with a concave portion into which the disk-like convex portion may be engaged and a plurality of protrusions being provided around the concave.

It is also preferred that the disk-like convex portion of the large gear is engaged to the concave portion of the small gear and simultaneously to a plurality of protrusions of the small gear are engaged to the recess portions of the large gear, wherein the large and small gears may operate as normal gears when the left and right side portions of the chassis are being hinged to each other and the protrusions of the small gear are dislocated to depart from the recess portions of the large gear to come into an idling state when the left and right side portions of the chassis are compulsorily hinged to each other by the external force.

It is also preferred that a toy vehicle further comprises a chassis having a control unit for controlling the second drive unit.

It is also preferred that the control unit comprise a switch mechanism for having the second drive unit turn on or off.

It is also preferred that the control unit be controlled by a radio-control for controlling the second drive unit.

It is also preferred that the control unit be controlled by a wire-remote-control for controlling the second drive unit.

It is also preferred that the toy vehicle further comprises a detecting unit for detecting individual positions of the left and right side portions being hinged with each other.

It is also preferred that the detecting unit may supply a signal for stopping the left and right side portions from being hinged to each other when an included angle formed between the left and right side portions of the chassis reaches the maximum or minimum value.

It is also preferred that the detecting unit comprises a contact piece being provided to the left or right side portion of the chassis and rotating with the left or right side portion of the chassis and the second drive unit having a switch for turning off the motor by contacting the contact piece.

It is also preferred that the detecting unit comprises a contact piece being provided to the left or right side portions of the chassis and rotating with the left or right side portions of the chassis and the second drive unit having a switch for turning off the motor by removing it from contact with the contact piece.

It is also preferred that the toy vehicle further comprises a chassis having at least one drive unit for driving the tires and the coupling unit having at least one second drive unit for making the left and right side portions of the chassis hinged to each other.

It is also preferred that the toy vehicle further comprises a driving mechanism being provided in the left and right side portions of the chassis and being connected to the first drive unit for driving the tires.

It is also preferred that the driving mechanism comprises a plurality of gears arranged between the tires to transmit a driving power generated by the drive unit into the tires.

It is also preferred that the second drive unit further comprises a first gear being attached at least the left or right side portions of the chassis for making the left and right side portions of the chassis hinged to each other, at least one second gear being engaged with the first gear for driving first gear and a motor being connected to the second gear for driving the second gear.

It is also preferred that the second gear further comprises at least one first driving gear being connected with the motor, at least one transmission gear being engaged to the first driving gear for transmitting a driving power generated at the motor and at least one or more second drive gears being engaged with one of the transmission gears and the first gear attached to at least the left or right side portions of the chassis for rotating the first gear to make the left and right side portions of the chassis hinged to each other.

It is also preferred that the second gear further comprises a clutch mechanism for preventing the gears from break when an external force is added to the toy vehicle so that the left and right side portions are compulsorily hinged.

It is also preferred that the clutch mechanism comprises large and small gears adapted to act as the second gears, wherein the large gear is provided in its center portion with a disk-like convex portion and a plurality of recess portions provided around the disk-like portion, the small gear is provided with a concave portion into which the disk-like convex portion may be engaged and a plurality of protrusions being provided around the concave.

It is also preferred that the disk-like convex portion of the large gear is engaged to the concave portion of the small gear and simultaneously to a plurality of protrusions of the small gear are engaged to the recess portions of the large gear, wherein the large and small gears may operate as normal gears when the left and right side portions of the chassis are being hinged to each other and the protrusions of the small gear are dislocated to depart from the recess portions of the large gear to come into an idling state when the left and right side portions of the chassis are compulsorily hinged to each other by the external force.

It is also preferred that the toy vehicle further comprises a chassis having a control unit for controlling the first and second drive units.

It is also preferred that the control unit comprise a switch mechanism for having the first and second drive units turn on or off.

It is also preferred that the control unit be controlled by a radio-control for controlling the first and second drive units.

It is also preferred that the control unit may be controlled by a wire-remote-control for controlling the first and second drive units.

It is also preferred that the control unit may supply a first control signal for controlling the first driving unit and a second control signal for controlling the second driving unit.

It is also preferred that when the second control signal is supplied from the control unit to the second drive unit, the first control signal is simultaneously supplied from the control unit to the first drive unit to make the toy vehicle run in the forward or backward direction.

It is also preferred that the toy vehicle further comprises a detecting unit for detecting individual positions of the left and right side portions being hinged with each other.

It is also preferred that the detecting unit may supply a signal for stopping the left and right side portions from being hinged to each other when an included angle formed between the left and right side portions of the chassis reaches the maximum or minimum value.

It is also preferred that the detecting unit comprises a contact piece being provided to the left or right side portion of the chassis and the second drive unit having a switch for turning off the motor by contacting the contact piece.

It is also preferred that the detecting unit comprises a contact piece being provided to the left or right side portion of the chassis and rotating with the left or right side portion of the chassis and the second drive unit having a switch for turning off the motor by removing it from contact with the contact piece.

It is also preferred that the tread of each the tire has a curvature.

It is also preferred that the tires have a spherical-like shape.

It is also preferred that the tires have a hemispherical-like shape.

It is also preferred that the toy vehicle further comprises the body, chassis and tires being sealed and fins being provided to a root of each the tire for paddling the water to run on the surface of water.

In accordance with the invention, there is provided a toy vehicle comprising a body, a chassis on which the body is mounted through connecting members, support members, one end of which is attached to the chassis through a coupling member to allow the support member to swivel, other end of which is provided with a tire, at least one first drive unit being provided to the chassis for driving the tire and at least one second drive unit being provided to the coupling member for swiveling the support members, thereby swiveling the support members to change the load clearance of the toy vehicle.

In accordance with the present invention, there is also provided a toy vehicle comprising a body, a chassis on which the body is mounted through connecting members, support members standing in a vertical direction, the support members being attached to the chassis through coupling members to go the chassis up and down along the support members, one end of which is provided with the tire, at least one first drive unit being provided to the chassis for driving the tire and at least one second drive unit being provided to the coupling member for moving the chassis up and down along the support members, thereby moving the chassis up and down along the support members to change a load clearance of the toy vehicle.

It is also preferred that the coupling member comprises a rack being provided to the support member and a pinion being provided to the chassis to engage with the rack, in which the pinion is driven by the second drive unit to move on the rack, as a result of which the chassis raises and lowers to change the load clearance to toy vehicle.

BRIEF DESCRIPTION OF THE DRAWINGS

Preferred embodiments of the present invention will hereinafter fully be described in detail with reference to the accompanying drawings.

PREFERRED EMBODIMENTS OF THE INVENTION

A first embodiment according to the present invention will be described with reference to drawings.

Figure 1:
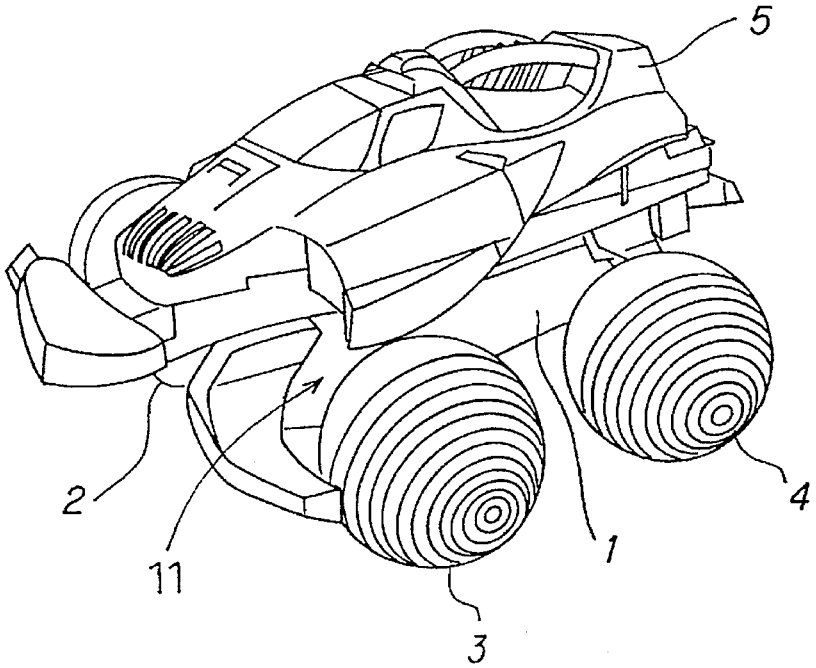
FIG. 1 is a perspective view showing a toy vehicle in the normal running form in a first embodiment according to the invention.
Figure 2:
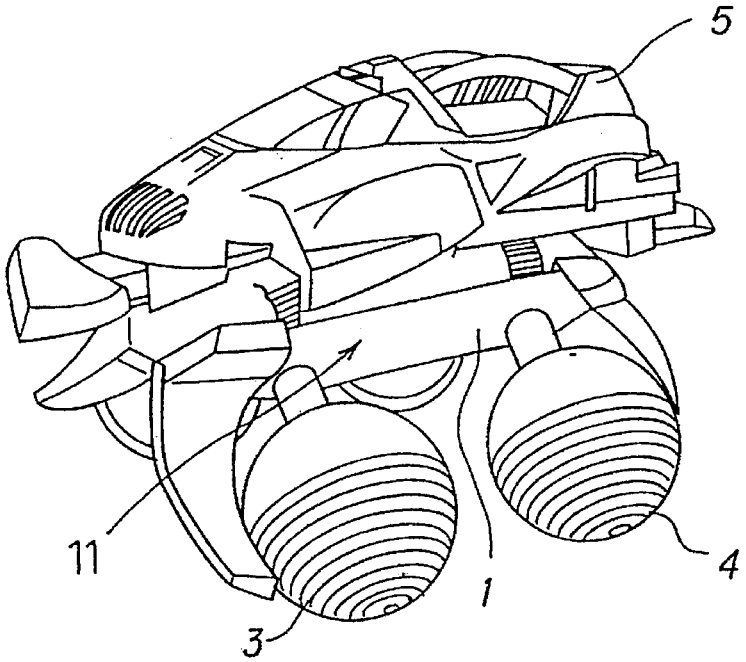
FIG. 2 is a perspective view showing a toy vehicle wherein a load clearance is raised in a first embodiment according to the invention.

FIG. 1 is a perspective view of a toy vehicle of the invention in a normal running form. FIG. 2 is a perspective view of the same in a raised road clearance state. The toy vehicle of the first embodiment comprises a body 5, a chassis 11 being provided with spherical front and rear tires 3 and 4 through a rotating shaft (not shown in FIGS. 1 and 2).

The chassis 11 is divided at a center axis along the longitudinal direction thereof into two parts of right and left side portions 1 and 2, both of which are so coupled as to hinge with each other on the center axis of the chassis 11.

FIG. 1 illustrates the toy vehicle placed in the first state where the center axis of the chassis 11 is positioned at the same level as the opposite sides of the chassis 11 so that the left and right side portions may be included in a plane or form a single plane. In this state, the center axis of the chassis 11 is set at the lowest level and a distance between the front tires or between the rear tires is set maximum.

FIG. 2 illustrates the toy vehicle placed in a second state where the center axis of the chassis 11 is positioned at a higher level than a level of the opposite sides of the chassis 11 so that the left and right side portions is bent in relation to each other through the hinge-connected portion on the center axis of the chassis 11. In this state, the center axis of the chassis 11 is set at the highest level and a distance between the front tires or between the rear tires is set minimum.

A bent angle between the left and right side portions 1 and 2 may freely and smoothly be changed within any states restricted between the first and second states. The bent angle between the left and right side portions 1 and 2 may also be kept in any states between the first and second states. When the left and right side portions 1 and 2 are so bent in relation as to each other to have the first flat state come into the second bent state, then the center axis of the chassis 11 is raised from the lowest level up to the highest level and also the distance between the front tires or between the rear tires is reduced from the maximum value to the minimum value.

The above change of the chassis 11 may result in changes in height of the body of the toy vehicle and also in the distances between the front tires or between the rear tires so that the toy vehicle shows attractive performance and improves actual running ability thereof.

Hinging the left and right side portions 1 and 2 to each other for changing a load clearance causes friction between the treads of the front and rear tires 3 and 4 and the ground. The spherical tires are suitable, since a line contact can always be obtained to reduce the friction between them in the case of adopting the spherical tires to the toy vehicle. Further, the tires which have a hemispherical shape or have a curvature at its tread are usable for the toy vehicle of the first embodiment, since the line contact can also be obtained like the spherical tires.

The largest possible footprint of the spherical tire in contact with the ground is created when the level of the center portion of the chassis 11 remains at the same height as that of the outside end portions of the chassis 11, as shown in FIG. 1. On the other hand, the smallest possible footprint of the spherical tire in contact with the ground is created when the level of the center portion of the chassis 11 remains that of the outside end portion of the chassis 11, as shown in FIG. 2. Therefore, if the left and right side portions 1 and 2 of the chassis 11 reach any position by their hinging operation, a part of the spherical tires may surely contact with the ground so that the toy vehicle can run regardless of the bending of the left side and right side portions 1 and 2 in relation to each other. Further, since the line contact can be obtained by use of the spherical tires, the friction between the tread of the tires 3 and 4 and the ground is considerably reduced.

In addition, a speed of the toy vehicle may be changed corresponding to an amount of contact the spherical tires with the ground. When the toy vehicle is running in the lowest state as shown in FIG. 1, the toy vehicle can run at its fastest speed because the footprint of the spherical tires is at its largest size. Therefore, the speed of the toy vehicle may be changed depending on the bending state of the left and right side portions 1 and 2 even the driving power or a rotation speed of the tires is kept constant.

The toy vehicle of the first embodiment is also provided with a driving unit such as an electric motor, a reciprocating or a rotary engine, a control unit for controlling the driving unit and a radio-signal transmitter for transmitting driving signals to the control unit as well as a drive mechanism for making the right and left side portions 1 and 2 hinge to each other. The above structure will be described in more detail below.

Figure 3:
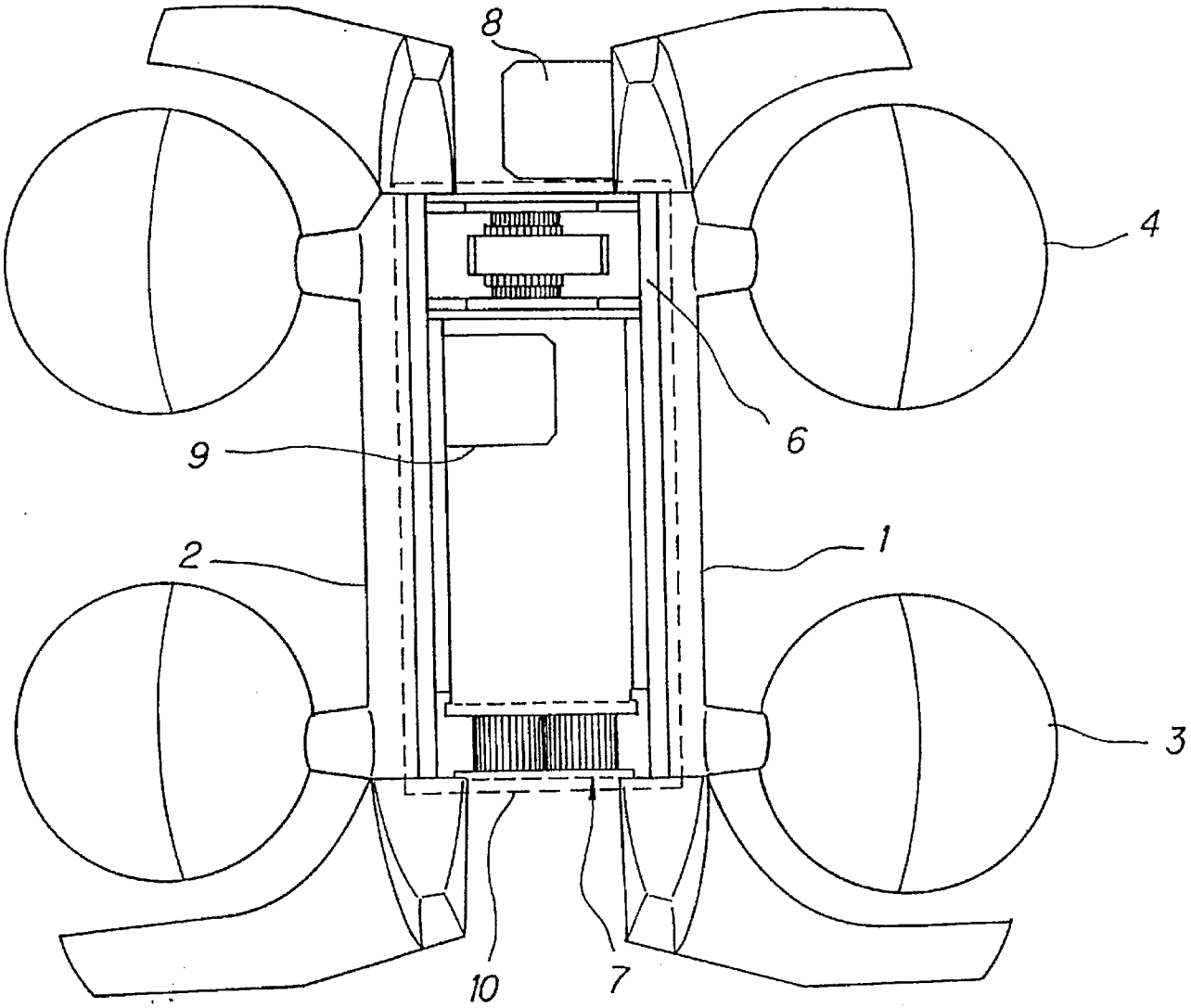
FIGS. 3 is a plan view showing a chassis of a toy vehicle from which a body is removed in a first embodiment according to the invention.

FIG. 3 is a plan view showing the toy vehicle from which the body 5 is removed. As shown in FIG. 3, the chassis 11 is divided at a center axis along the longitudinal direction of the chassis 11 into the right and left side portions 1 and 2, both of which are coupled by a synchronized driving unit 6 and a coupling unit 7 to hinge each other. The right and left side portions 1 and 2 are provided with a drive mechanism (not shown in FIG. 3) respectively inside thereof for driving each of the front and rear tires 3 and 4, and provided with a driving unit 8 and 9 for driving the front and rear tires 3 and 4 through the drive mechanism respectively.

The synchronized driving unit 6 comprises a motor for making the right and left side portions 1 and 2 hinge to each other and a plurality of gears for transmitting a driving power generated at the motor, while the coupling device 7 comprises a plurality of gears for coupling the right and left side portions 1 and 2. The synchronized driving unit 6 and the coupling unit 7 will fully be described below.

A plate 10 as shown in FIG. 3 is provided on the top of the synchronized driving unit 6 and the coupling unit 7 for mounting other parts such as a control unit and batteries.

Figure 4:
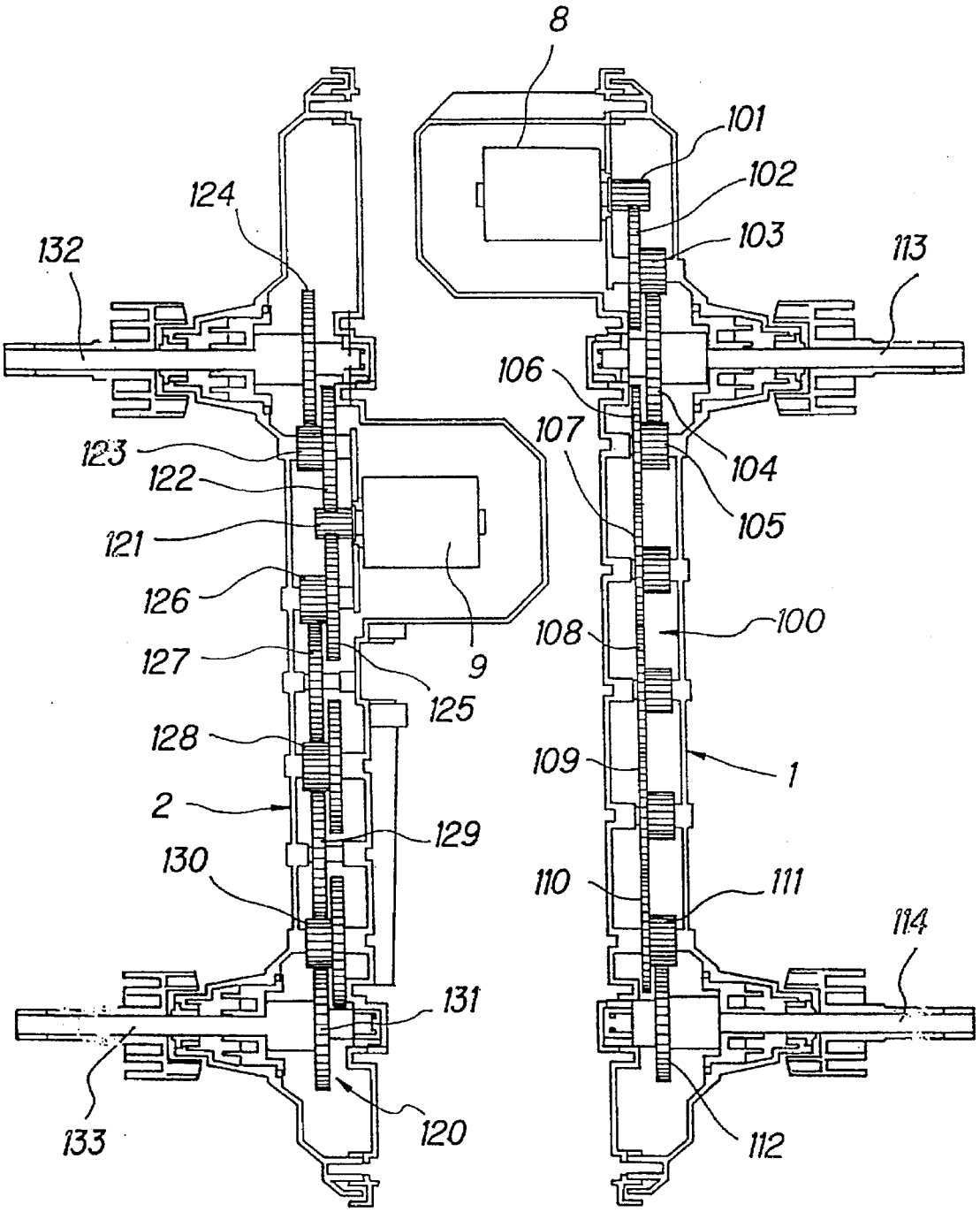
FIG. 4 is a horizontal cross sectional view showing a driving mechanism comprising motors and gears of a toy vehicle in a first embodiment according to the invention.

FIG. 4 is a cross sectional view showing the right and left side portions 1 and 2 taken in the horizontal direction. The front and rear tires 3 and 4, illustrations of the synchronized driving device 6 and the coupling device 7 are omitted from FIG. 4.

The right side portion 1 is provided with a first driving mechanism 100 comprising a plurality of gears arranged between the front tires 3 and between rear tires 4 respectively. The plurality of gears comprises a first gear 101 provided with a rotating shaft of the motor 8, a second gear 102 engaged with the first gear 101, a third gear 103 provided to the same rotating shaft of the second gear 102, a fourth gear 104 engaged with the third gear 103 when driving the left rear tire 4 through a rotating shaft 113, a fifth gear 105 engaged with the fourth gear 104, a sixth gear 106 provided to the same rotating shaft of the fifth gear 105, a seventh gear 107 engaged with the sixth gear 106, an eighth gear 108 engaged with the seventh gear 107, a ninth gear 109 engaged with the eighth gear 108, a tenth gear 110 engaged with the ninth gear 109, an eleventh gear 111 provided to the same rotating shaft of the tenth gear 110, and a twelfth gear 112 engaged with the eleventh gear 111 when driving the right front tire 3 through a rotating shaft 114.

Since the right side portion 1 has the first drive mechanism 100, the front and rear tires 3 and 4 in the left side are driven by receiving the driving power transmitted from the driving unit 8 through the plurality of the above gears. Concretely, the driving power of the driving unit 8 is transmitted through the plurality of gears 101, 102 and 103 to the rotating shaft 113, as a result of which the rotating shaft 113 is rotated to drive the right side rear tire 4. The driving power of the drive unit 8 is also transmitted through the plurality of gears 104–112 to the rotating shaft 114, as a result of which the rotating shaft 114 is rotated to drive the right side front tire 3.

On the other hand, the left side portion 2 is also provided with a second drive mechanism 120 comprising a plurality of gears arranged between the front tire 3 and between the rear tires 4 respectively. The plurality of gears comprises a first gear 121 provided with the rotating shaft of the drive unit 9, a second gear 122 engaged with the first gear 121, a third gear 123 provided to the same rotating shaft of the second gear 122, a fourth gear 124 engaged with the third gear 123 when driving the right side rear tire 4 through a rotating shaft 132, a fifth gear 125 engaged with the first gear 121, a sixth gear 126 provided to the same rotating shaft of the fifth gear 125, a seventh gear 127 engaged with the sixth gear 126, an eighth gear 128 engaged with the seventh gear 127, a ninth gear 129 engaged with the eighth gear 128, tenth gear 130 engaged with the eighth gear 129, and an eleventh gear 131 engaged with the tenth gear 130 when driving the left side front tire 3 through a rotating shaft 133.

In the second drive mechanism 120 of the left side portion 2, the driving power of the drive unit 9 is transmitted through the plurality of gears 121, 122, 123 and 124 to the rotating shaft 132, as a result of which the rotating shaft 132 is rotated to drive the left side rear tire 4. The driving power of the driving unit 9 is also transmitted through the plurality of gears 121 and 126–131 to the rotating shaft 133, as a result of which the rotating shaft 133 is rotated to drive the left side front tire 3.

The drive units 8 and 9 may drive the first and second drive mechanisms 100 and 120 respectively in accordance with the control signal from the control unit, which will fully be described below, to enable the toy vehicle to run in both forward and backward directions. The driving units 8 and 9 may be controlled to change a speed of rotation of each tire 3 and 4 for turning the toy vehicle right and left. In other words, when turning the toy vehicle left, the speed of rotation of the driving unit 8 becomes faster than that of the driving unit 9 whereas in turning the toy vehicle right, the speed of rotation of the drive unit 9 becomes faster than that of the drive unit 8. Therefore, the speeds of rotation of left and right side tires are different or independent from each other so that the toy vehicle may be turned to the side on which the rotation speed of the tires is slower than that of the opposite side.

Figure 5:
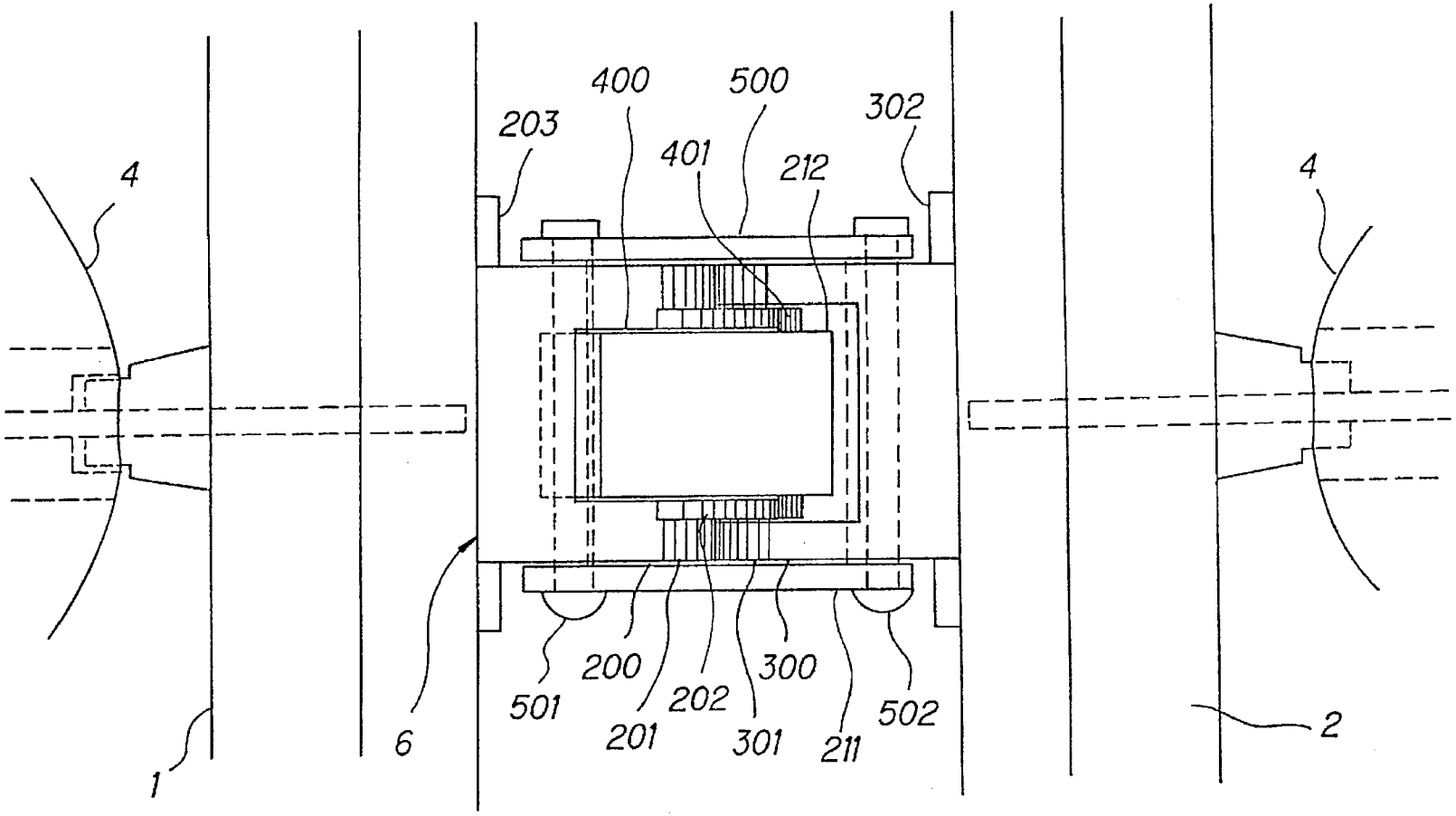
FIG. 5 is an enlarged plan view of a synchronized driving unit for changing a load clearance of a toy vehicle in a first embodiment according to the invention.
Figure 6:
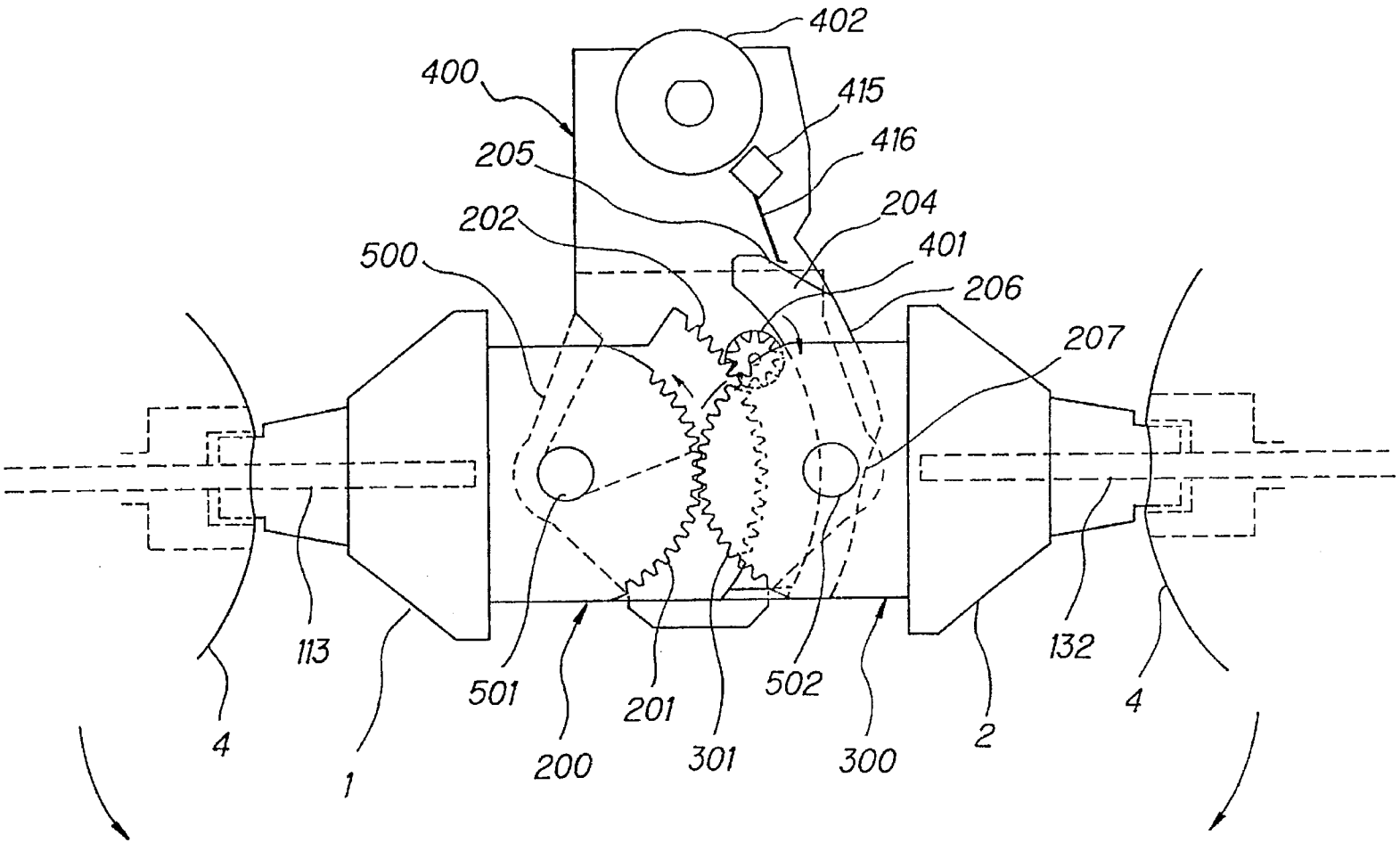
FIG. 6 is an enlarged elevational view showing a synchronized driving unit for changing a load clearance of a toy vehicle in a first embodiment according to the invention.
Figure 7:
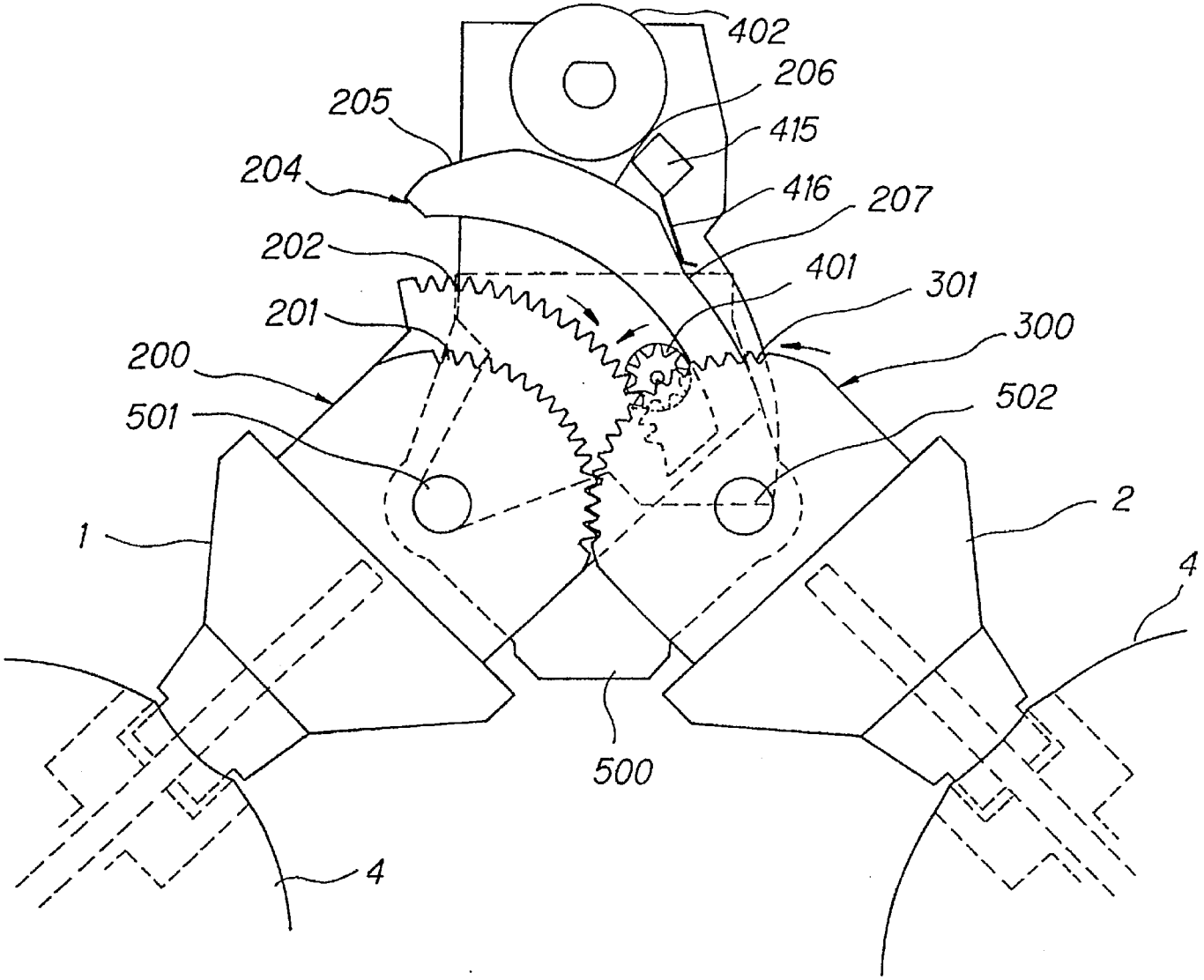
FIG. 7 is an enlarged elevational view showing a synchronized driving unit for changing a load clearance of a toy vehicle in a first embodiment according to the invention.
Figure 8:
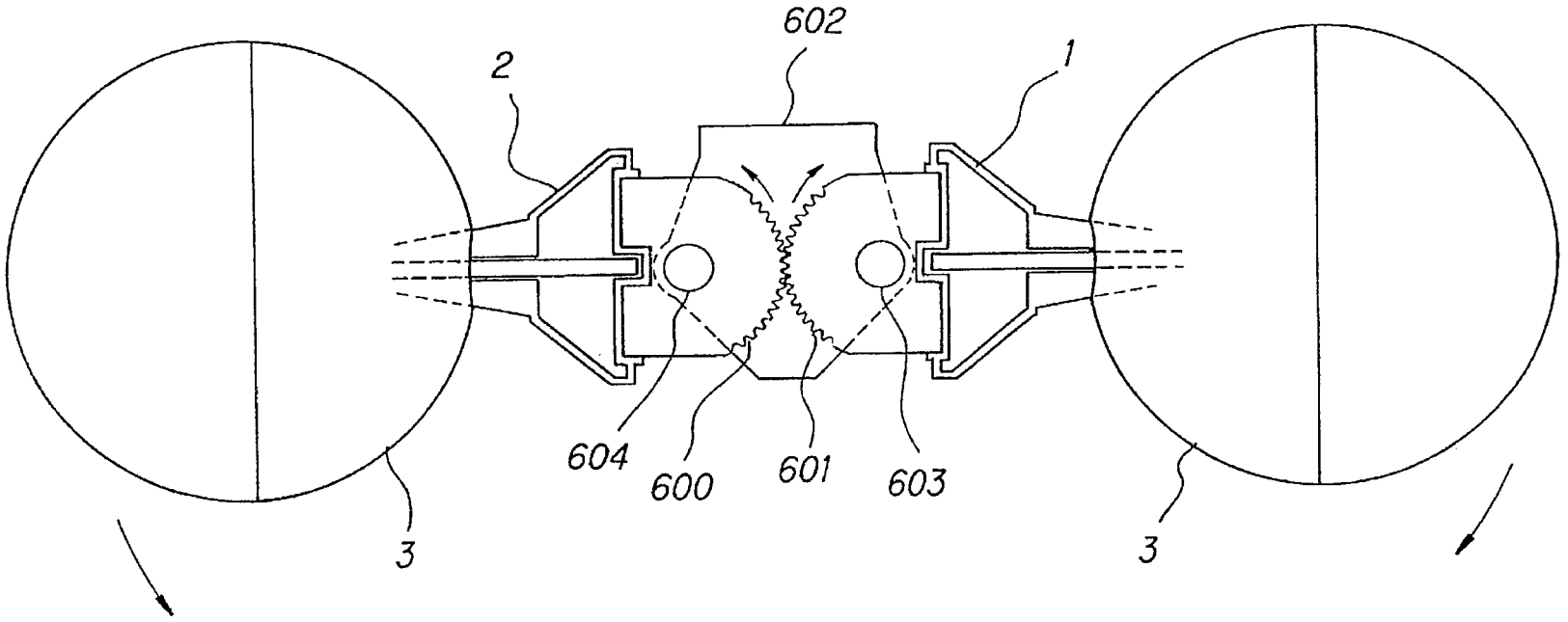
FIG. 8 is an enlarged elevational view showing a coupling unit provided between front tires for changing a load clearance of a toy vehicle in a first embodiment according to the invention.
Figure 9:
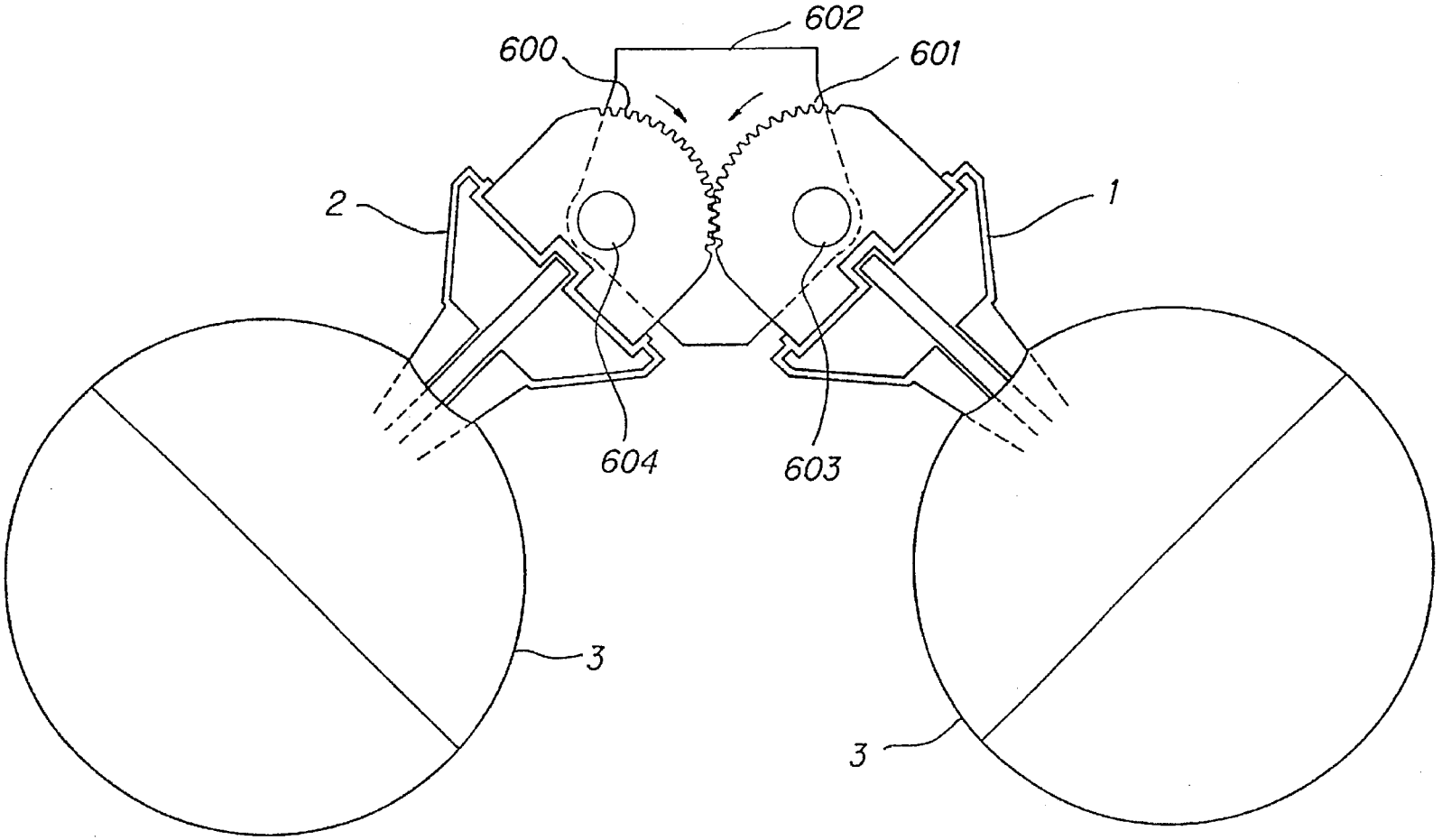
FIG. 9 is an enlarged elevational view showing a coupling unit provided between front tires for changing a load clearance of a toy vehicle in a first embodiment according to the invention.

FIGS. 5 through 9 show the synchronized driving unit 6 and the coupling unit 7 for connecting the right and left side portions 1 and 2 of the chassis 11. FIG. 5 shows a plan view of the synchronized driving unit 6. FIGS. 6 and 7 are elevational views of the synchronized driving unit 6. FIGS. 8 and 9 are elevational views of the coupling unit 7. A hinge mechanism for the right and left side portions to change the road clearance will be fully described below.

Referring to FIG. 5 to 7, the right side portion 1 is provided with a first coupling gear 200 through a mounting member 203. The first coupling gear 200 comprises a pair of a first gear 201 and a second gear 202 spaced apart from each other at a predetermined distance. Those gears are also provided with a gear portion and having teeth at their upper side and a flat face for attaching to the right side portion 1 of the chassis 11 at their lower side.

On the other hand, the left side portion 2 is provided with a second coupling gear 300 through a mounting member 302. The second coupling gear 300 comprises a pair of a first gear 301 spaced apart from each other at a predetermined distance. The first gear 201 of the right side portion 1 is provided to be engaged with the first gear 300 of the right side portion 2. The second coupling gear 301 is also provided with a gear portion and having teeth at its upper side and a flat face for attaching to the left portion 2 of the chassis 11.

The first and second coupling gears 200 and 300 becomes apart from a rectangle area, to which a synchronized driving device 400 is provided, when engaging their gears. A synchronized driving device 400 is provided to the rectangle area for rotating the first and second coupling gear 200 and 300 to hinge the right and left side portion 1 and 2 of the chassis 11. The synchronized driving device 400 comprises a plurality of gears, one of which is engaged with the second gears 202 of the first coupling gear 200 to hinge the right and left side portions 1 and 2. The first and second coupling gears 200 and 300 are put between stationary plates 500 to fasten them with stationary tools such as bolts and nuts through-holes.

Figure 10:
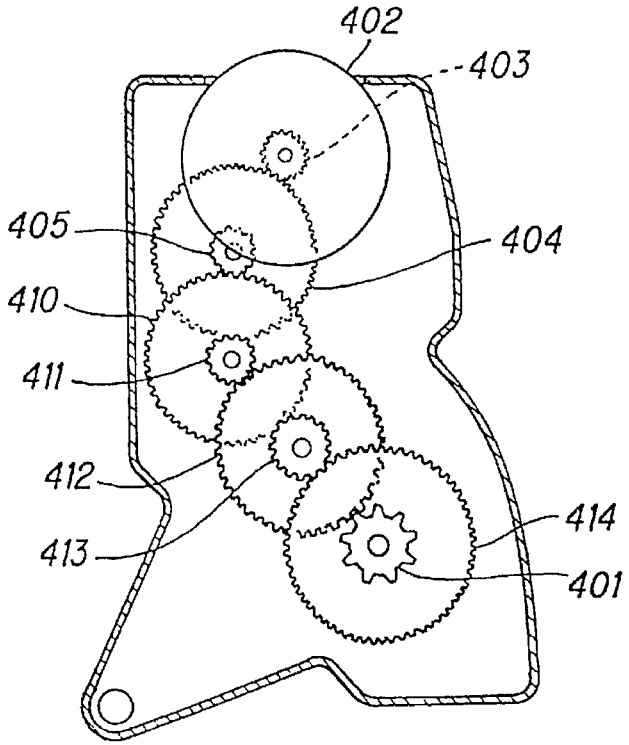
FIG. 10 is a vertical cross sectional view showing a synchronized driving device for driving a synchronized driving unit to change a load clearance of a toy vehicle in a first embodiment according to the invention.
Figure 11:
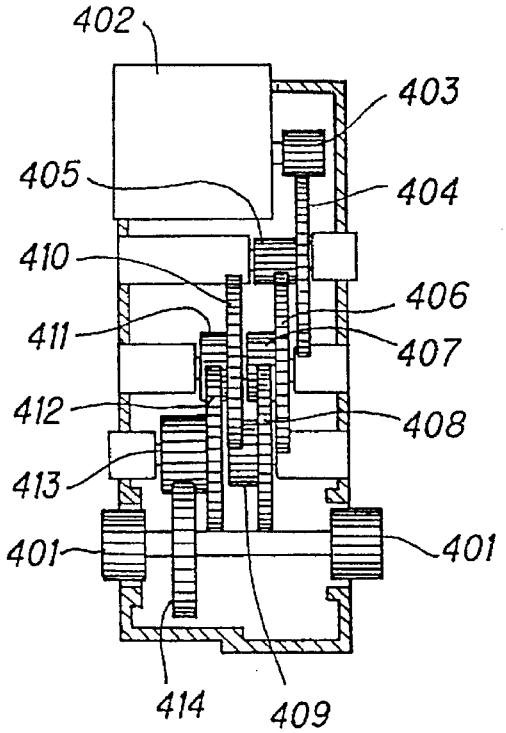
FIG. 11 is a horizontal cross sectional view showing a synchronized driving device for driving a synchronized driving unit to change a load clearance of a toy vehicle in a first embodiment according to the invention.

FIGS. 10 and 11 show vertical and horizontal cross sectional views of the synchronized driving device 400. The synchronized driving device 400 comprises a motor 402 and a plurality of gears for transmitting a driving power generated at the motor 402 and for changing a gear ratio. Thus, the number of gears may be changed to match the various conditions over the design. The set of gears comprises a first gear 403 provided to the same rotating shaft of the motor 402, a second gear 404 engaged with the first gear 403, a third gear 405 provided with the same rotating shaft of the second gear 404, a fourth gear 406 engaged with the third gear 405, a fifth gear 407 provided to the same rotating shaft of the fourth gear 406, a sixth gear 408 engaged with the fifth gear 407, a seventh gear 409 provided to the same rotating shaft of the sixth gear 408, an eighth gear 410 engaged with the seventh gear 409, a ninth gear 411 provided to a rotating shaft of the eighth gear 410, a tenth gear 412 engaged with the ninth gear 411, an eleventh gear 413 provided to the rotating shaft of the tenth gear 412, a twelfth gear 414 engaged with the eleventh gear 413, a thirteenth gear 401 provided to the same rotating shaft of the twelfth gear 414 and engaged with the second gear 202 of the first coupling gear 200 of the right side portion 1. According to the above structure, a driving power of the motor 402 can be transmitted to the thirteenth gear through the plurality of the gears 403 to 413, thereby rotating the first and second coupling gears 200 and 300 to bend the right and left side portions 1 and 2 in relation to each other.

Referring to FIGS. 8 and 9, the coupling unit 7 comprises first and second coupling gears 600 and 601 engaged with each other and a pair of stationary plates 602 for supporting engagement of the first and second coupling gears 600 and 601 (see FIGS. 3, 8 and 9). The first and second coupling gears 600 and 601 are also provided with a gear portion having tooth of gear at their upper side and a flat portion for attaching them to the right and left side portions 1 and 2 of the chassis 11. Namely, each of the first and second coupling gears 600 and 601 are provided to the left and right side portions 1 and 2 to be engaged with each other and they are put between the stationary plates 602 to be fastened with be stationary tools such as bolts and nuts through stationary holes.

Operations of the synchronized driving unit 6 and the coupling unit 7 are described with reference to the drawings. The synchronized driving unit 6 and the coupling unit 7 are in a condition shown in FIGS. 6 and 8.

In operation, the motor 402 is driven by the control unit (not shown) to rotate the plurality of gears of the synchronized driving device 400, thereby rotating the thirteenth gear 401 protruding therefrom in a clockwise direction. The thirteenth gear 401 makes the second gear 202 of the first coupling gear 200 rotate in a counterclockwise direction to swivel the left side front and rear tires 3 and 4 in the same direction. Simultaneously, the first gear 201 of the first coupling gear 200 which is integrated with the second gear 202 is rotated and makes the first gear 301 of the second coupling gear 300 rotate in a clockwise direction to swivel the right side front and rear tires 3 and 4 in the same direction. The direction of rotating of each gear is shown in FIG. 6.

In the coupling unit 7, the first coupling gear 600 is rotated in a counterclockwise direction depending on the operation of the synchronized driving unit 6. The second coupling gear 601 is also rotated in a clockwise direction because of engaging with the first coupling gear 600 and the operation of the synchronized driving unit 6. The direction of rotating of each gear is also shown in FIG. 8.

As described above, the right and left side portions 1 and 2 are bent in relation to each other on the center axis along the longitudinal direction of the chassis 11 in accordance with the operations of the synchronized driving unit 6 and the coupling unit 7. As a result, the center portion of the chassis 11 is raised and the load clearance of the toy vehicle is also raised. In other words, an included angle formed between the right and left side portions 1 and 2 can be reduced to raise the road clearance of the toy vehicle. If the included angle formed between the right and left side portions 1 and 2 is reduced to reduce a track between the left and right side tires, then a triangle whose top angle is the included angle, is formed by the left and right side portions and the ground plane, thereby changing the road clearance from the ground plane to the center portion of the chassis 11 depending upon the included angle. Since the widths of the right and left side portions 1 and 2 are not changed, the included angle is reduced to enable the road clearance of the toy vehicle to become higher.

Further, referring to FIGS. 6 and 7, the synchronized driving device 400 is provided with a switch 415 which makes the motor 402 stop at its side wall when the included angle formed between right and left side portions 1 and 2 reaches maximum or minimum value. The switch 415 has a movable contact 416 for controlling the motor 402 to be turned off.

While the first coupling gear 200 is provided with a contact piece 204 extending from the side portion of the first coupling gear 200 and having a L-shaped cross section for contacting to the movable contact 416 to turn the motor 402 off. The contact piece 204 is rotated with the first coupling gear 200 to enable the movable contact 416 to turn the motor 402 off. The L-shaped contact piece 204 has a first, second and third face 205, 206 and 207. The first face 205 and the third face 207 are inclined to the second face 206, each of which discontact from the movable contact 416 when the included angle between the right and left side portions 1 and 2 reaches the maximum or minimum value. In this embodiment, the switch 415 is turned on to make the drive of the motor 402 stop forcibly when the movable contact 416 is removed from contact with the contact piece 204.

In the operation of raising up the road clearance of the toy vehicle, when the included angle formed between the left and right side portions 1 and 2 reaches the minimum angle, then the switch is turned on to make the drive of the motor 402 stop forcibly. On the other hand, when the included angle reaches the maximum angle, then the switch is also turned on to make the drive of the motor 402 stop forcibly.

Even if the operation for raising up the road clearance of the toy vehicle was forcibly stopped by the switch 415 as described above, the operation can be stopped at any included angle by the control unit as described below. Thus, the predetermined road clearance is obtained in the toy vehicle of the first embodiment. In addition, instead of the above mentioned operations of a switch 415, the switch 415 may be turned on when the piece contact 204 contacts with the movable contact 416 while the switch 415 may be turned off when the piece contact 203 is removed from contact with the movable contact 416.

Furthermore, when the toy vehicle collides with a wall and the like, the collision makes an impact on the synchronized driving device 400 and results in the teeth of the gears breaking. Therefore, a clutch mechanism is applied to one of the gears 404 to 414 provided in the synchronized driving device 400.

Figures 12A, 12B, 12C:
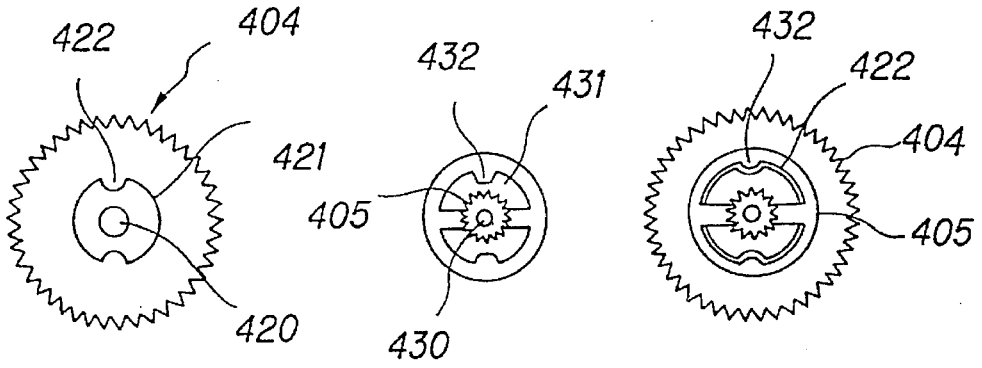
FIGS. 12A to 12C are plan views showing gears of a clutch mechanism involved in a synchronized driving device of a toy vehicle in a first embodiment according to the invention.

FIGS. 12A through 12C are plan views showing the clutch mechanism which is applied to the gears 404 and 405 in the synchronized driving device 400. FIG. 12A shows the second gear 404. FIG. 12B shows the third gear 405. FIG. 12C shows the clutch mechanism formed by combination of the gears 404 and 405.

The second gear 404 is provided with a disk-like convex portion 421 at a center axis 420 and the disk-like convex portion 421 also is provided with recess portions 422. The third gear 405 is provided with a concave portion 431 into which the disk-like convex portion 421 of the second gear 404 may be snapped (or engaged). The concave portion 431 surrounds a center axis 430 of the third gear 405 and is provided with protrusions 432 to be engaged into the recess portions 422 of the second gear 404 respectively.

For formation of the clutch mechanism, the disk-like convex portion 421 of the second gear 404 is engaged or snapped into the concave portion 431 of the third gear 405 and also the protrusions 432 of the third gear 405 are engaged or snapped into the recess portions 422 of the second gear 404. Thus, the clutch mechanism can transmit the driving power of the motor 402 because of engaging the protrusions 432 with the recess portions 422, namely the driving power from the first gear 403 is transmitted to the second gear 404 to enable the combination of the protrusions 432 and the recess portions 422 to transmit it to the third gear 405 in the synchronized driving device 400. After that, the driving power is transmitted to the fourth gear 406 from the third gear 405 for rotating the first and second coupling gears 200 and 300 to raise the load clearance up.

When the toy vehicle collides with the wall and the like, the collision makes an impact on the synchronized driving device 400, as a result of which the right and left side portions 1 and 2 are forcibly hinged through the synchronized driving unit 6 and the coupling unit 7. In this case, the protrusions 432 of the third gear 405 are dislocated from the recess portions 422 of the second gear 404, and then only the third gear 405 becomes idling state on the disk-like convex portion 421 of the second gear 405. According to this operation, the clutch mechanism lets the collision go off the synchronized driving device 400 to prevent the teeth of the gears and the motor 402 from breaking.

Figure 13:
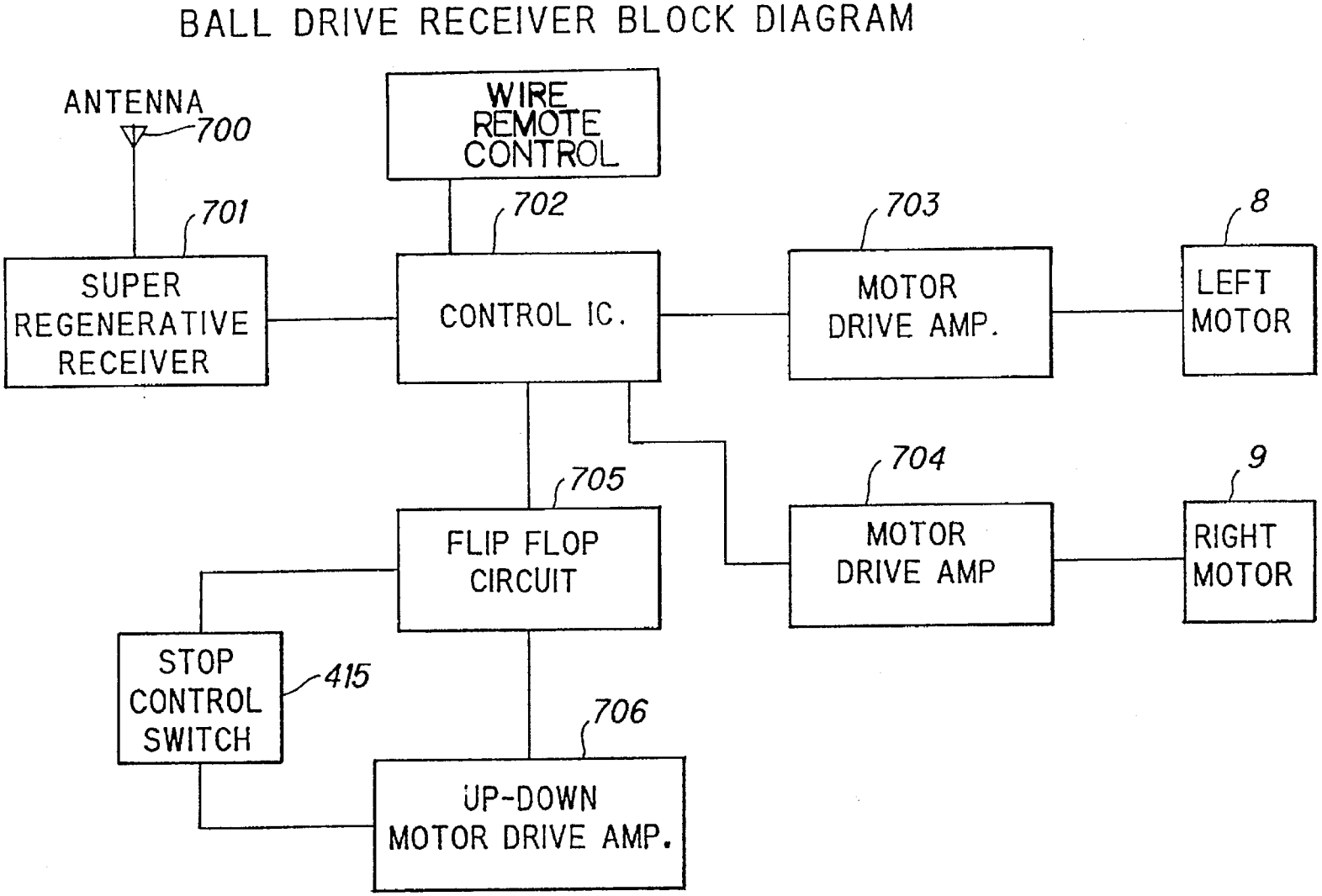
FIG. 13 is a block diagram showing a control unit for controlling of running and changing a load clearance of a toy vehicle in a first embodiment according to the invention.

FIG. 13 is a block diagram showing the control unit controlling the first and second drive mechanisms 100 and 120, the driving units 8 and 9, the synchronized driving device 400 and the motor 402. The control unit comprises an antenna 700 for receiving signals from the radio-signal transmitter (not shown), a super regenerative receiver 701, a control IC 702 receiving the signals from the super regenerative receiver 701 to control each unit, motor drive amplifiers 703 and 704 controlled by the control IC 702 to drive the driving units 8 and 9 respectively, a flip-flop circuit 705 controlled by the control IC 702 to make the road clearance of the toy vehicle change, an UP-DOWN motor drive amplifier 706 for driving the motor 402 of the synchronized driving device 400 and a stop control switch 415 for making the drive of the motor 402 stop as described above.

Figure 14:
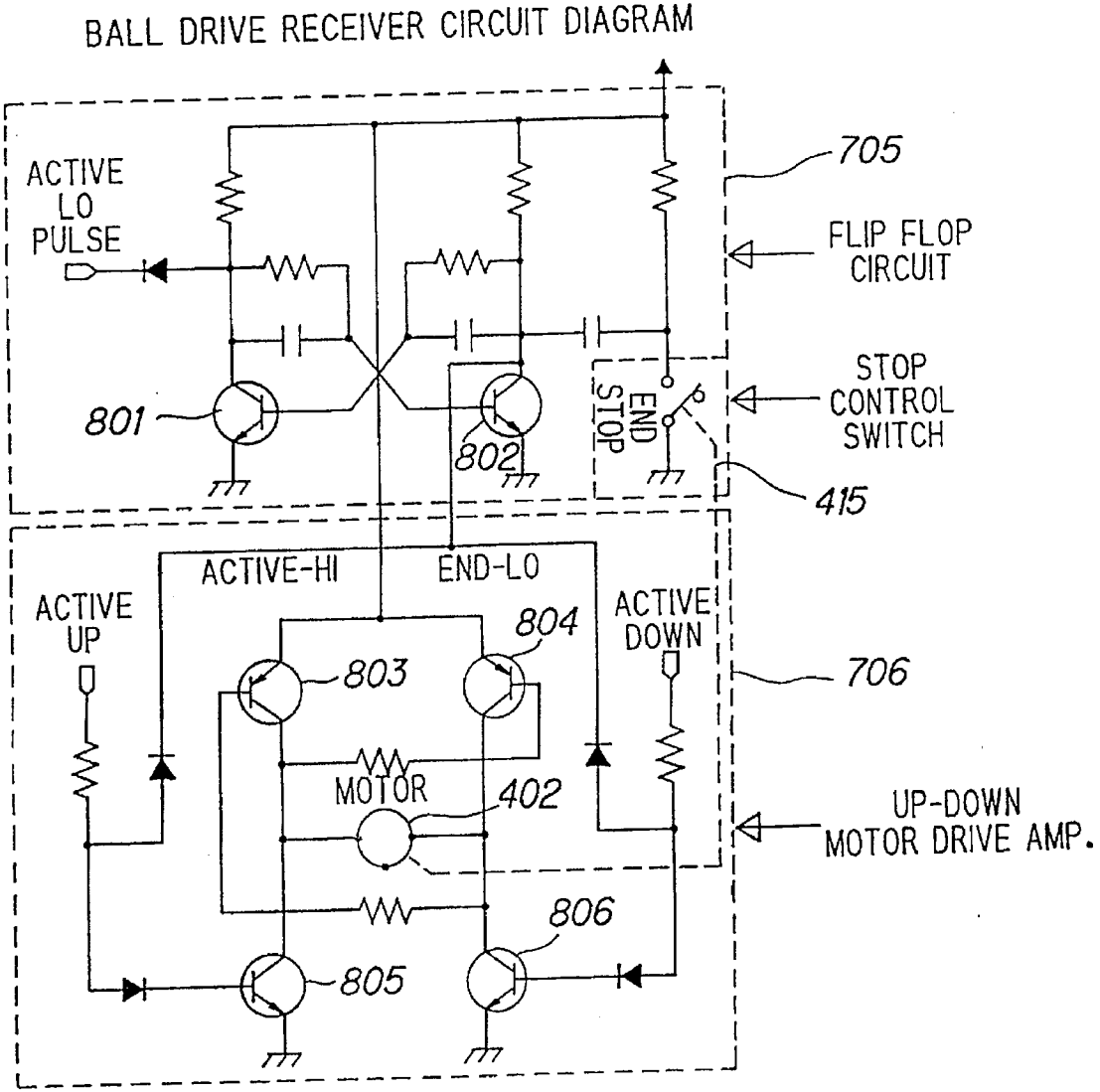
FIG. 14 is a circuit diagram showing a control unit shown in FIG. 13 in a first embodiment according to the invention.

FIG. 14 is a circuit diagram showing a part of the control unit for changing the road clearance of the toy vehicle. The flip-flop circuit 705 is controlled by a control signal, i.e., an active LO pulse from the control IC 702 and the stop control switch 415 to drive the motor 402. The UP-DOWN motor drive amplifier 706 comprises four transistors to let the motor 402 rotate normally or invertedly according to the control signal from the control IC 702.

For operation of raising the road clearance, the control signal from the radio-signal transmitter (not shown) is supplied to the control IC 702. Subsequently, the LO pulse is supplied from the control IC 702 to the flip-flop circuit 705, as a result of which the transistor 801 turns on, while the transistor 802 turns off. A road clearance UP signal is supplied from the flip-flop circuit 705 to the UP-DOWN motor drive amplifier 706 to allow the transistors 804 and 805 to turn on. Therefore, the motor 402 in the synchronized driving device 400 is driven to have the right and left side portions 1 and 2 hinge to reduce the included angle formed between those portions 1 and 2, thereby raising the road clearance of the toy vehicle. When obtaining an intended road clearance of the toy vehicle, the transmission of the control signal may be stopped. If the road clearance UP signal is continuously supplied to the control unit, the first coupling gear 200 is rotated in the clockwise direction, according to which the movable contact 416 is off the contact piece 205 at the third face 207 of the contact piece 205. The transistor 802 is, then, turned on and since the road clearance UP signal is supplied to the transistor 802, the drive of the motor 402 is stopped.

On the other hand, when bringing down the road clearance of the toy vehicle, a control signal is transmitted from the radio transmitter (not shown) to the control IC 702. Subsequently, the LO pulse is supplied from the control IC 702 to the flip-flop circuit 705 to let the transistor 801 turn on and to let the transistor 802 turn off. At that time, a road clearance DOWN signal is supplied from the control IC 702 to the UP-DOWN motor drive amplifier 706 to allow the transistors 803 and 806 to turn on. Therefore, the road clearance DOWN signal is supplied to the transistor 802 and thus the motor 402 is stopped.

For changing the road clearance of the toy vehicle, the right and left side portions 1 and 2 are hinged with each other at the center axis along the longitudinal direction of the chassis 11, in other words, the track between tires are changed. This operation causes a friction between the tires and the ground since the tires are dragged on the ground in a direction intersecting the running direction of the toy vehicle. To settle the above issue, when the road clearance of the toy vehicle is intended to change, a control signal for driving the driving units 8 and 9 is supplied from the control IC 702 to the UP-DOWN motor drive amplifier 706 for enabling the toy vehicle to run slowly. Therefore, the friction between the tires and the ground may be reduced and the road clearance of the toy vehicle may smoothly be changed.

In the first embodiment, although the toy vehicle is explained about the radio control, this may be replaced by wire remote control. Instead of the control unit of the first embodiment, a switch which can only turn on or off a power supply may be employed as the control unit to control the driving units 8 and 9 and the motor 402 of the synchronized driving device 400. Further, the road clearance of the toy vehicle may be changed by a manual control without employing the drive unit.

Furthermore, even if only one synchronized driving unit 6 is provided for coupling the left side portion 1 with the right side portion 2, a plurality of which may be provided thereto. Though the synchronized driving unit 6 comprises the first and second coupling gears 200 and 300, the right and left side portions 1 and 2 may be hinged by only the first coupling gear 200 without use of the second coupling gear 300.

Figure 15A:
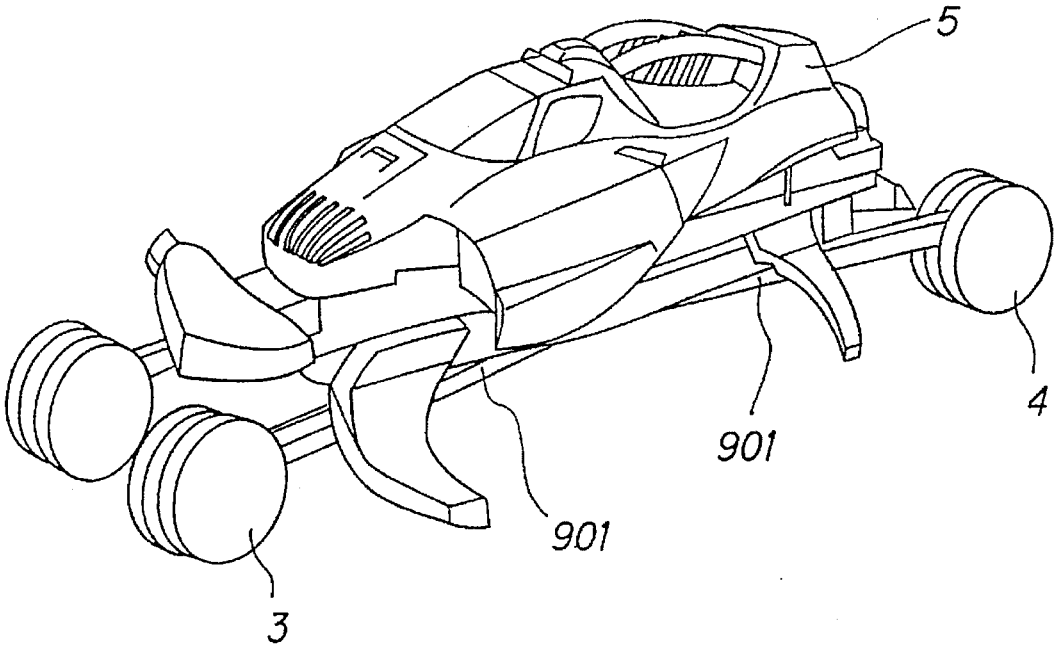
FIGS. 15A and 15B are perspective views showing a modification of a toy vehicle in a first embodiment according to the invention.
Figure 15B:
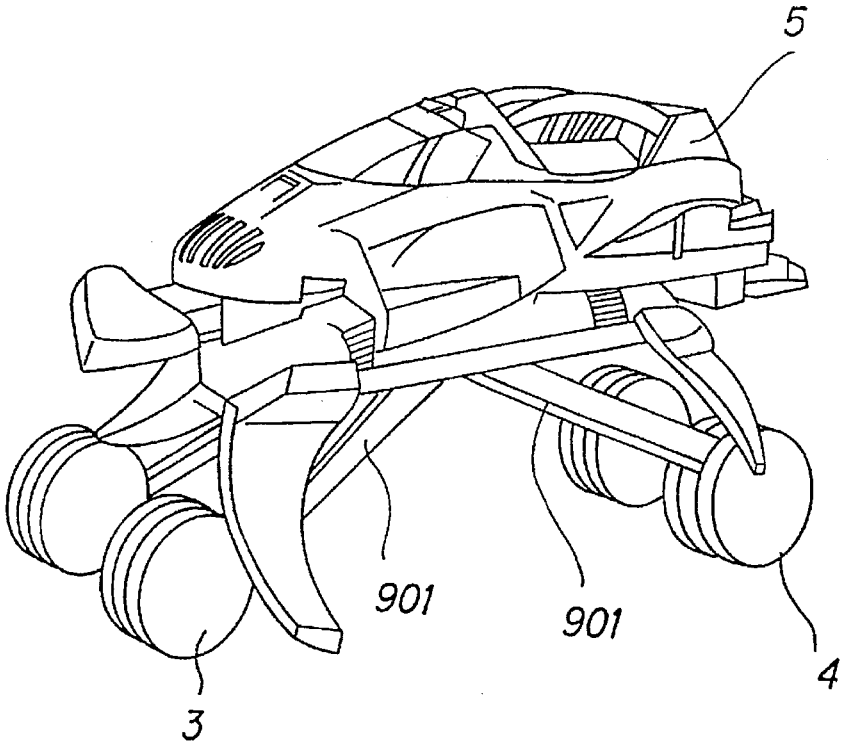

Next, modifications of the first embodiment will be described with reference to FIGS. 15A, 15B, 16A and 16B. FIGS. 15A shows a first modification of the toy vehicle in the normal running state and FIG. 15B shows the same state as raised its road clearance. The toy vehicle of the first embodiment has the chassis 11 which is divided into the right and left side portions 1 and 2, in which the right and left side portions 1 and 2 are hinged with each other for changing the road clearance of the toy vehicle. The toy vehicle of the first modification, however, comprises a body 5, a chassis 11 and support members 901. The support members 901 are connected to the chassis 11 through its one end, in which the support member 901 is allowed to swivel in a longitudinal direction of the body 5 and chassis 11 at the one end as a fulcrum. The support members 901 also have tires 3 and 4 at their another end.

In the first modification, it is easily possible to change the road clearance of the toy vehicle by providing the synchronized driving unit 6 provided in the first embodiment. In addition, if the direction of swiveling the support members 901 is changed to a horizontal direction intersecting the running direction, the road clearance of the toy vehicle may similarly be changed.

Figure 16A:
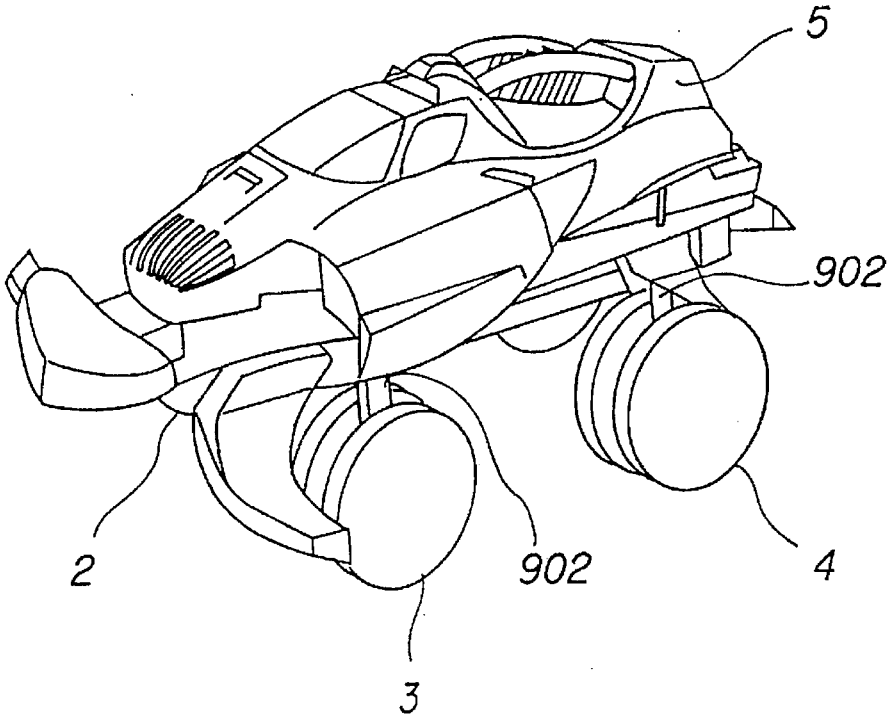
FIGS. 16A and 16B are perspective views showing a modification of a toy vehicle in a first embodiment according to the invention.
Figure 16B:
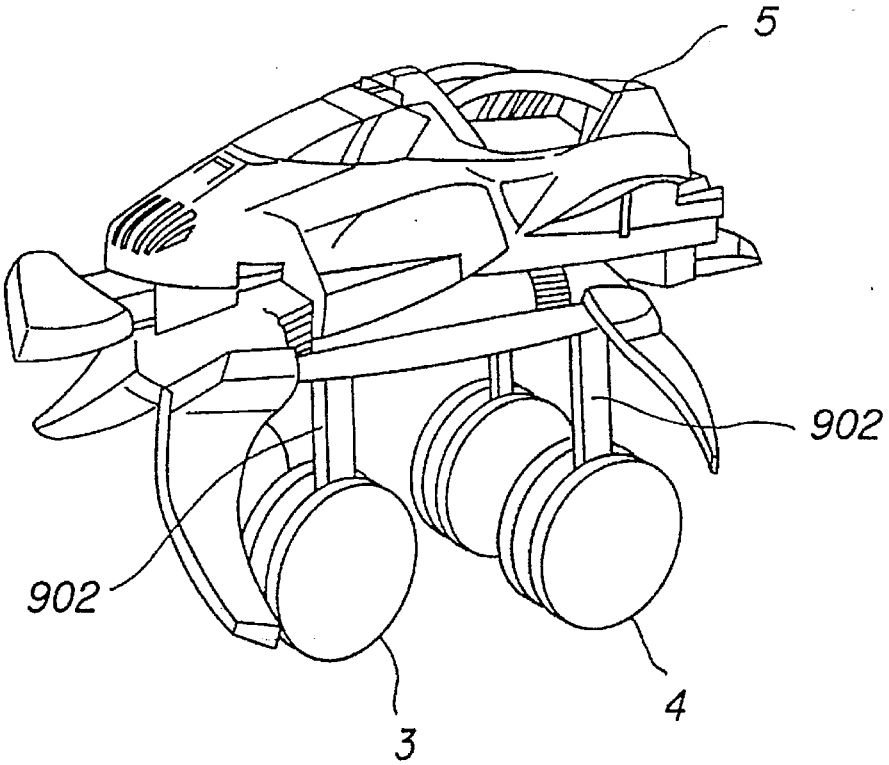

FIG. 16A shows a second modification of the toy vehicle of the first embodiment in a normal running state and FIG. 16B shows the same state as raised its road clearance. The second modification of the toy vehicle comprises a body 5, a chassis 11 and support members 902 having tires 3 and 4. The support member 902 is raised in a vertical direction, one end of which is connected to the chassis 11 and another end of which is provided with a tire acting as a front tire 3 or a rear tire 4, in which the body 5 and the chassis 11 go up and down along with the support members 902.

In the toy vehicle, each of the support members 902 is provided with a rack (not shown) and the chassis 11 is provided with a pinion corresponding to the rack and a motor for driving the pinion. It may clearly be understood on the basis of the above constitutions that the pinion is driven by the motor to move it on the rack, as a result of which the body 5 and chassis 11 of the toy vehicle are permitted to go up and down along with the support members 902.

As described above, according to the first embodiment of the invention, since the toy vehicle can make its road clearance change, the toy vehicle can get over the obstacle easily. In addition, the road clearance of the toy vehicle can easily be changed to hinge the right and left side portions 1 and 2, thus resulting in the road clearance changeable toy vehicle in a simple structure. Namely, the right and left side portions 1 and 2 are coupled by the synchronized driving unit 6 and the coupling unit 7 comprising the plurality of the gears and to change of the road clearance can easily be carried out by the gears driven by the motor. On the other hand, since the driving mechanisms 100 and 120 are provided in right and left side portions 1 and 2, the toy vehicle can run by the driving mechanisms 100 and 120 driven by the drive units 8 and 9.

Figure 17:
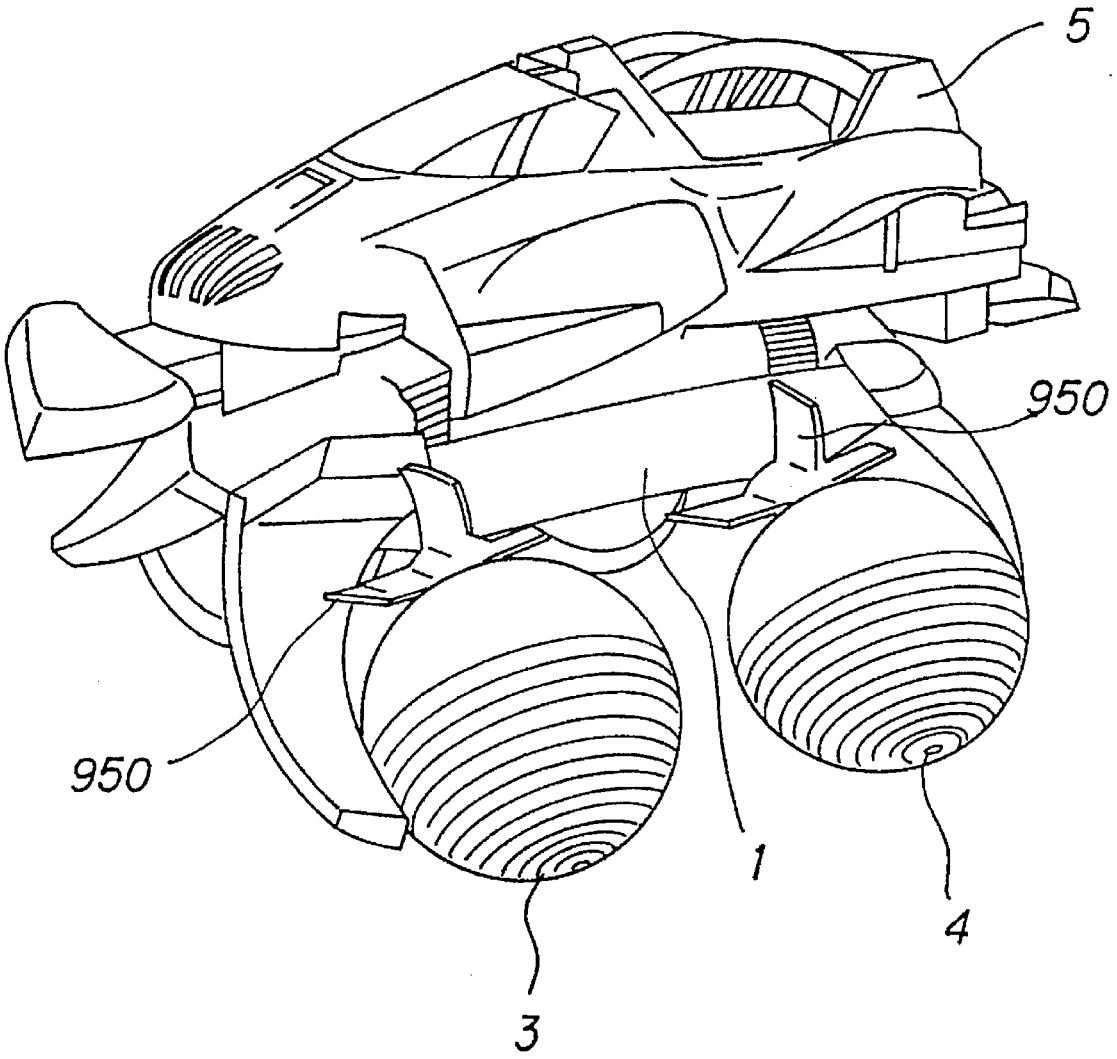
FIG. 17 is a perspective view showing a toy vehicle provided with fins at rotating shaft of front and rear tires in a first embodiment according to the invention.

The second embodiment will be described with reference to FIG. 17. In the second embodiment, any explanation of the same structure as the first embodiment will be omitted.

In the toy vehicle of the second embodiment, the body 5, the right and left side portions 1 and 2, and the tires 3 and 4 are sealed for preventing parts provided inside of them from entering into water and the like thereinto. In particular, the front and rear tires are formed to be hollow by sealing them. In addition, the rotating shaft of the front and rear tires 3 and 4 are provided with fins 950 for paddling water to run on the surface of water.

According to the second embodiment, since the front and rear tires are spherical and hollow, they can serve for a float and thus the toy vehicle may be floated on the surface of the water. As a result, the fins 950 rotate together with the rotation shaft by driving the drive motor 8 and 9 to paddle the water and to run on the surface of water. Therefore, if there is a pond on the way of a destination of the toy vehicle, it is possible for the toy vehicle to run go straight to the destination without going round it.

Whereas modifications of the present invention will no doubt be apparent to a person of ordinary skilled in the art to which the invention pertains, it is to be understood that the embodiments shown and described by way of illustration are by no means intended to be considered in a limiting sense. Accordingly, it is to be intended by the claims to cover all modifications of the invention which fall within the spirit and scope of the invention.

What is claimed is:

1. A toy vehicle comprising:

a body;

a chassis on which said body is mounted through connecting members and being provided with at least front and rear tires, said chassis being divided on a center axis along a longitudinal direction of said chassis into two parts comprising left and right side portions;

a means provided on said center axis for coupling said left and right side portions of said chassis to hinge said left and right side portions with each other;

a drive mechanism being provided to each of said left and right side portions of said chassis to connect with each of said tires through each said drive mechanism; and at least one first drive unit being provided to each said driving mechanism for simultaneously driving said tires;

a second drive unit being provided to said coupling means for making said left and right side portions of said chassis hinge.

2. A toy vehicle according to claim 1, wherein said second drive unit further comprises:

a first gear being attached to at least one of said left and right side portions of said chassis for making said left and right side portions of said chassis hinge with each other;

at least one second gear being engaged to said first gear for driving said first gear; and a motor being connected to one of said at least one second gear for driving said at least one second gear.

3. A toy vehicle according to claim 2, wherein said at least one second gear further comprises:

at least one first drive gear being connected with said motor;

at least one transmission gear being engaged with said first drive gear for transmitting a driving power generated at said motor; and at least one second drive gear being engaged with one of said transmission gears and said first gear attached to at least said left or right side portions of said chassis for rotating said first gear to make said left and right side portions of said chassis hinge with each other.

4. A toy vehicle according to claim 2, wherein said at least one second gear further comprises a clutch mechanism for preventing said gears from destroying when an external force is added to said toy vehicle so that said left and right side portions are compulsorily hinged with each other.

5. A toy vehicle according to claim 4, wherein said clutch mechanism comprises large and small gears adopted to act as said at least one second gear, said large gear is provided with a disk-like convex portion at its center axis and recess portions being provided around said disk-like convex portion, said small gear is provided with a concave portion into which said disk-like convex portion may be engaged and protrusions being provided around said concave portion.

6. A toy vehicle according to claim 5, wherein said disk-like convex portion of said large gear is engaged into said convex portion of said small gear and simultaneously protrusions of said small gear are engaged into said recess portions of said large gear, in which said large and small gears operate as normal gears when said left and right side portions of said chassis are being hinged with each other and said protrusions of said small gear are dislocated from said recess portions of said large gear to enter into idling state when said left and right side portions of said chassis are compulsorily hinged with each other by said external force.

7. A toy vehicle according to claim 1, further comprising means being provided to said chassis for controlling said second drive unit.

8. A toy vehicle according to claim 7, wherein said control means comprises a switch mechanism to have said second drive unit turn on or off.

9. A toy vehicle according to claim 7, wherein said control means operates by receiving a radio-control signal for controlling said second drive unit.

10. A toy vehicle according to claim 7, wherein said control means operates by receiving a wire-remote-control signal for controlling said second drive unit.

11. A toy vehicle according to claim 7, further comprising means provided to said chassis for detecting a position of said left and right side portions being hinged with each other.

12. A toy vehicle according to claim 11, wherein said detecting means supply a signal for stopping hinging said left and right side portions with each other when an included angle formed between said left and right side portions of said chassis reaches a maximum or minimum value.

13. A toy vehicle according to claim 11, wherein said detecting means comprises a contact piece being provided to said left or right side portion of said chassis and rotating with said left or right side portions and a switch being provided to said second drive unit for turning off said motor provided to said second drive unit by contacting with said contact piece.

14. A toy vehicle according to claim 11, wherein said detecting means comprises a contact piece being provided to said left or right side portions of said chassis and rotating with said left or right side portions and a switch being provided to said second drive unit for turning off said motor provided to said second drive unit by discontacting from said contact piece.

15. A toy vehicle comprising:

a body;

a chassis on which said body is mounted through connecting members and being provided with at least front and rear tires, said chassis being divided on center axis along a longitudinal direction of said chassis into two parts comprising left and right side portions; and means provided on said center axis for coupling said left and right side portions of said chassis to hinge said left and right side portions with each other;

at least one first drive unit being provided to said chassis for driving said tires; and at least one second drive unit being provided to said coupling means for making said left and right side portions of said chassis hinge with each other.

16. A toy vehicle according to claim 15, further comprising a drive mechanism being provided into said left and right side portions of said chassis and being connected to said first drive unit for driving said tires.

17. A toy vehicle according to claim 16, wherein said driving mechanism comprises a plurality of gears arranged between said tires to transmit a driving power generated at said drive unit to said tires.

18. A toy vehicle according to claim 15, wherein said second drive unit further comprises:

a first gear being attached to at least one of said left and right side portions of said chassis for making said left and right side portions of said chassis hinge with each other;

at least one second gear being engaged with said first gear for driving said first gear; and a motor being connected to said at least one second gear for driving said at least one second gear.

19. A toy vehicle according to claim 18, wherein said at least one second gear further comprises:

at least one first drive gear being connected with said motor;

at least one transmission gear being engaged with said at least one first drive gear for transmitting a driving power generated at said motor; and at least one second drive gear being engaged with one of said transmission gears and said first gear attached to at least one of said left and right side portions of said chassis for rotating said first gear to make said left and right side portions of said chassis hinge with each other.

20. A toy vehicle according to claim 18, wherein said at least one second gear further comprises a clutch mechanism for preventing said gears from destroying when an external force is added to said toy vehicle so that said left and right side portions are compulsorily hinged.

21. A toy vehicle according to claim 20, wherein said clutch mechanism comprises large and small gears adapted to act as said at least one second gear, said large gear is provided with a disk-like convex portion at a center axis thereof and recess portions being provided around said disk-like convex portion, said small gear is provided with a concave portion having a shape into which said disk-like convex portion may be engaged and protrusions being provided around said concave portion.

22. A toy vehicle according to claim 21, wherein said disk-like portion of said large gear is engaged into said concave portion of said small gear and simultaneously protrusions of said small gear are engaged into said recess portions of said large gear, in which said large and small gears operate as a normal gear when said left and right side portions of said chassis are being hinged with each other and said protrusions of said small gear are dislocated from said recess portions of said large gear to entering into idling state when said left and right side portions of said chassis are compulsorily hinged with each other by said external force.

23. A toy vehicle according to claim 15, further comprising means being provided to said chassis for controlling said first and second drive units.

24. A toy vehicle according to claim 23, wherein said control means comprises a switch mechanism to have said first and second drive units turn on or off.

25. A toy vehicle according to claim 23, wherein said control means operates by receiving a radio-control signal for controlling said first and second drive units.

26. A toy vehicle according to claim 23, wherein said control means operates by receiving a wire-remote-control signal for controlling said first and second drive units.

27. A toy vehicle according to claim 23, wherein said control means supply a first control signal for controlling said first drive unit and a second control signal for controlling said second drive unit.

28. A toy vehicle according to claim 27, wherein when said second control signal is supplied from said control means to said second drive unit, said first control signal is simultaneously supplied from said control means to said first drive unit to make said toy vehicle go forwardly or backwardly.

29. A toy vehicle according to claim 23, further comprising means provided for detecting positions of said left and right side portions being hinged with each other.

30. A toy vehicle according to claim 29, wherein said detecting means supply a signal for stopping hinging said left and right side portions with each other when an included angle formed between said left and right side portions of said chassis reaches a maximum or minimum value.

31. A toy vehicle according to claim 29, wherein said detecting means comprises a contact piece being provided to said left and right side portions of said chassis and rotating with said left and right side portions of said chassis and a switch being provided to said second drive unit for turning off said motor provided to said second drive unit by contacting with said contact piece.

32. A toy vehicle according to claim 29, wherein said detecting means comprises a contact piece being provided to said left and right side portions of said chassis and rotating with said left and right side portions of said chassis and a switch being provided to said second drive unit for turning off said motor provided to said second drive unit by discontacting from said contact piece.

* * * * *